United States Patent [19]

Schwartz

[11] 4,003,285

[45] Jan. 18, 1977

[54] MUSIC SIGNAL CONVERSION APPARATUS

[76] Inventor: Louis A. Schwartz, 266 E. 211th St., Apt. 26, Bronx, N.Y. 10467

[22] Filed: Nov. 10, 1975

[21] Appl. No.: 630,744

[52] U.S. Cl. ..... 84/1.24; 84/1.01
[51] Int. Cl.[2] ..... G10H 1/04
[58] Field of Search ..... 84/1.01, 1.11, 1.12, 84/1.19, 1.24, 1.27

[56] References Cited

UNITED STATES PATENTS

| | | | |
|---|---|---|---|
| 3,535,431 | 10/1970 | Szabo | 84/1.11 |
| 3,629,484 | 12/1971 | Suzuki | 84/1.11 |
| 3,762,265 | 10/1973 | Adachi | 84/1.01 |

OTHER PUBLICATIONS

*Experimenting with Electronic Music* by Robert Brown & Mark Olson, pp. 95–100.

*Primary Examiner*—L. T. Hix
*Assistant Examiner*—Vit W. Miska
*Attorney, Agent, or Firm*—Jack D. Slobod

[57] ABSTRACT

Apparatus for converting the relatively rapid rise time, relatively long fall time tone envelopes of a music source output to envelopes having relatively long rise time and relatively rapid fall time includes a sawtooth relaxation oscillator whose output feeds a modulator which is also fed by the music source. The oscillator is turned on via a transistor switch when the average power of the signal at the output of the modulator exceeds a predetermined reference threshold signal.

1 Claim, 2 Drawing Figures

MUSIC SIGNAL CONVERSION APPARATUS

FIELD OF THE INVENTION

The present invention relates generally to apparatus for modifying a music signal for producing unusual effects. In its particular aspects, the present invention relates to a device for modulating a music signal with a sawtooth signal to produce an effect as if each individual tone signal thereof were played backwards.

BACKGROUND OF THE INVENTION

A musical note or tone produced by a musical instrument of string, piano or percussion types is characterized by an envelope having a relatively rapid rise time and a relatively slow, usually exponential, fall or decay time. If an isolated musical note signal of the aforementioned type were recorded, as with a tape recorder, and then played backwards, there would result a highly unusual and pleasing note signal having a slow rise and a rapid decay. Of course, however, music is composed of a sequence of notes and playing a prerecorded musical program backwards would yield the sequence of notes in backwards order.

OBJECTS OF THE INVENTION

It is an object of the present invention to provide apparatus for converting relatively rapid rise time, relatively slow fall time envelopes of musical note signals to envelopes having a relatively slow rise time and a relatively rapid fall time.

It is a further object of the present invention to provide apparatus for modulating a music signal with a sawtooth signal when the music signal power exceeds, on average, a predetermined threshold.

SUMMARY OF THE INVENTION

Briefly, the aforementioned and other objects of the present invention are satisfied by providing an apparatus having an input port for coupling to a source of music signal. The input port feeds one input terminal of a modulator. The other modulator input terminal is fed by the output of a sawtooth relaxation oscillator. The sawtooth output signal of the oscillator has a relatively slow rise time and relatively rapid fall time and while the envelope of each individual note signal from the music source has opposite rise and fall characteristics to the sawtooth signal, the result of the effective multiplication of the sawtooth and input music signal in the modulator creates note signals at the modulator output having slow rise time and rapid fall time. Consequently, each individual note signal from the music source is modified as if it were individually recorded and played back in time reversed form. However, the sequence of the note signals is unchanged.

If the sawtooth signal were continuously applied to the modulator even when the music signal were of relatively low amplitude, there would result undesirable switching noise introduced by the sawtooth signal. To avoid this noise, the sawtooth signal is applied to the modulator only when the music signal power exceeds a predetermined threshold. This is accomplished by utilizing rectifying and low pass filtering means coupled to the output of the modulator for producing a unidirectional control signal indicative of the average power in the output music signal. This control signal is compared with a predetermined D.C. reference signal in a comparator. The sawtooth oscillator includes a transistor switch positioned for applying power supply voltage to the oscillator. The transistor switch is controlled from the output of the comparator for turning on the sawtooth oscillator when the control signal exceeds the reference signal.

Other objects, features and advantages of the present invention will become apparent upon perusal of the following detailed description of the preferred embodiment of the present invention when taken in conjunction with the appended drawing wherein:

FIG. 1 is a block diagram for the music signal conversion apparatus of the present invention; and FIG. 2 is a detailed schematic diagram corresponding to the block diagram in FIG. 1.

DETAILED DESCRIPTION

Figure 1:
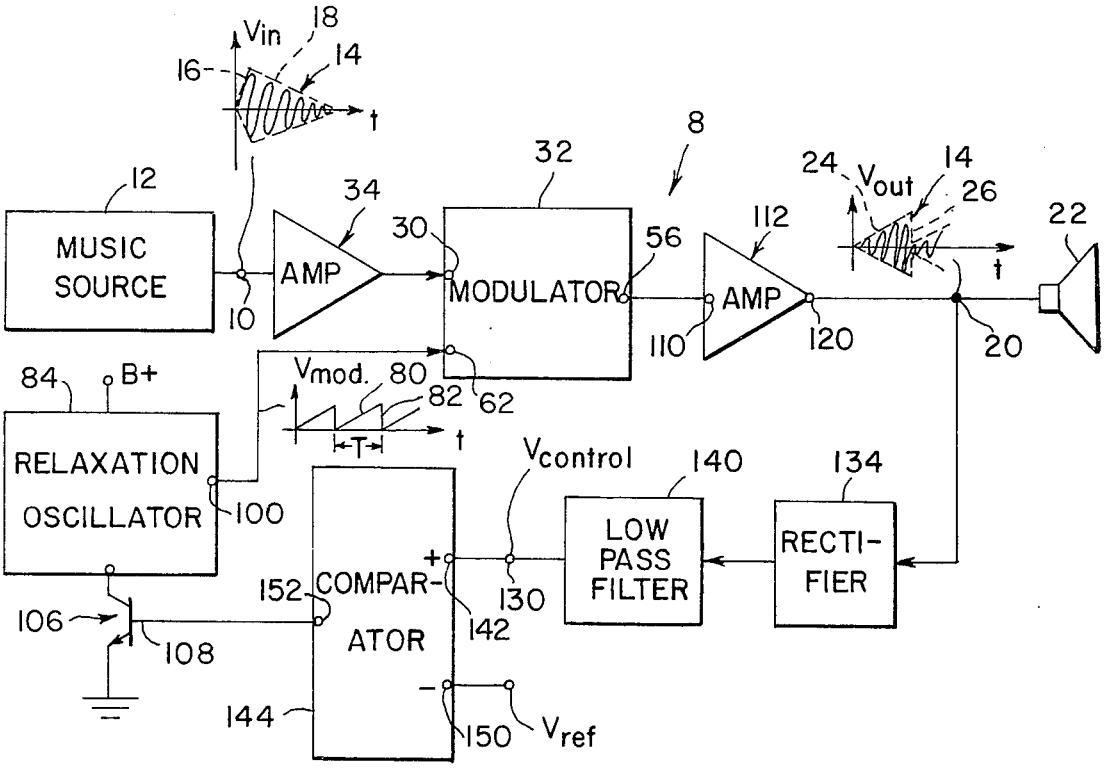
Figure 2:
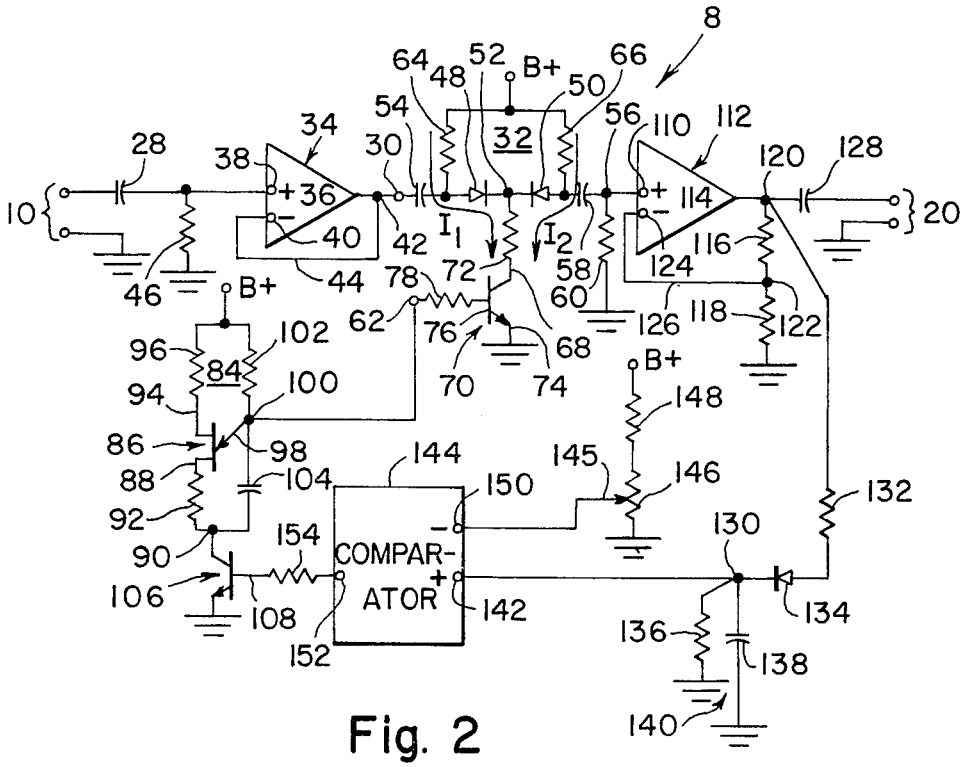

Referring to FIGS. 1 and 2 of the drawing, the music signal conversion apparatus 8 of the present invention includes an input port 10 adapted to be coupled to a music source 12. Source 12 provides a music input signal $V_{in}$ including note signals 14 as produced by musical instruments of the string, piano or percussion types. Note signals 14 are A.C. signals having envelopes characterized by a relatively rapid rising portion 16 and a relatively slow falling portion 18.

Apparatus 8 further has an output port 20 adapted to drive a speaker 22 with an output music signal $V_{out}$ in which the note signals 14 are modified to have an envelope including a relatively slow rising portion 24 and a relatively rapid falling portion 26. Consequently, each individual note signal 14 at output port 20 appears to be time reversed from the note signal 14 at input port 10. The manner in which this unusual effect is accomplished will become apparent as the discussion proceeds.

Preferably, the input port 10 is A.C. coupled via a capacitor 28 to an input terminal 30 of a modulator 32. A buffer amplifier 34 is interposed between capacitor 28 and input terminal 30. Buffer amplifier 34 is mechanized using a differential amplifier 36. Capacitor 28 is connected to a positive input terminal 38 of amplifier 36 while the negative input terminal 40 and output terminal 42 thereof are interconnected by a feedback lead 44 to provide buffer amplifier 34 with a unity gain. A resistor 46 is connected between amplifier input terminal 38 and ground to provide an input impedance at input port 10 matching the output impedance of source 12.

Amplifier output terminal 42 is connected to modulator input terminal 30. Modulator 32 is synthesized utilizing a pair of oppositely directed series diodes 48 and 50. The cathodes of diodes 48 and 50 are joined at a node 52. Modulator input terminal 30 is connected to the anode of diode 48 via a capacitor 54. An output terminal 56 of the modulator is connected to the anode of diode 50 via a capacitor 58 and a resistor 60 is connected between output terminal 56 and ground. The resistance of the series diodes 48, 50 form an A.C. voltage divider along with resistor 60. The resistances of diodes 48 and 50 are varied in correspondence to the instantaneous value of a sawtooth modulating signal $V_{mod}$ at a second input terminal 62 of modulator 32.

To accomplish this, a pair of resistors 64 and 66 are respectively connected between the positive supply voltage, B+, and the anodes of the respective diodes 48 and 50. Further, the node 52, between diodes 48 and 50 is coupled to the collector electrode 68 of an NPN transistor 70 via a resistor 72. The emitter electrode 74 of transistor 70 is grounded while its base electrode 76 is connected to the modulation input terminal 62 via a resistor 78.

The resistors 64, 66 and 72 are chosen for operation of the diodes 48 and 50 at relatively low current levels for varying the resistance of currents $I_1$ and $I_2$. Bias current $I_1$ flows through resistor 64, diode 48 and transistor 70 while bias current $I_2$ flows through resistor 66, diode 50 and transistor 70. These bias currents are increased in response to increasing signal at modulator input terminal 62 for decreasing the resistances of the diodes 48 and 50 and thereby increasing the fractional A.C. gain associated with the voltage divider formed by the diodes and resistor 60.

The modulating signal $V_{mod}$ is generally in sawtooth form composed of relatively slowly rising portions 80 and relatively rapidly falling portions 82. The period 80 and relatively rapidly falling portions 82. The period T associated with $V_{mod}$ is chosen slightly longer than the duration of the note signals 14, on the order of a second. The modulator 32 effectively multiplies $V_{in}$ and $V_{mod}$ to produce $V_{out}$.

$V_{mod}$ is produced by a relaxation oscillator 84 having an output terminal 100 coupled to the modulator input terminal 62. Oscillator 84 includes a unijunction transistor 86 whose first base electrode 88 is connected to a node 90 through a small current limiting resistor 92, such as 10 ohms. The second base electrode 94 of unijunction transistor 86 is connected to B+ via a resistor 96. The emitter electrode 98 of unijunction transistor 86 is directly connected to the output terminal 100 of oscillator 84. A resistor 102 is connected between B+ and terminal 100 while a capacitor 104 is connected between terminal 100 and node 90. Node 90 is connected to ground via an NPN transistor switch 106 for selectively enabling power supply voltage to be applied across oscillator 84.

When transistor switch 106 is rendered conductive by a suitably positive signal at its base electrode 108, the oscillator 84 is turned on. The oscillator 84 operates by capacitor 104 being charged through resistor 102, creating the slowly rising portion 80 of $V_{mod}$, until a suitable voltage is present on the capacitor for causing conduction between emitter electrode 98 and base electrode 88. At this point the capacitor 104 is rapidly discharged via the unijunction transistor 86, creating the rapidly falling portion 82 of $V_{mod}$.

The output terminal 56 of modulator 32 is coupled to the input terminal 110 of an amplifier 112 for providing suitable amplification and buffering for driving speaker 22. Amplifier 112 is formed by an operational amplifier 114 whose positive input terminal is the amplifier input 110. A voltage divider composed of series resistors 116 and 118 is connected between the operational amplifier output terminal 120 and ground. The junction 122 between resistors 116 and 118 is connected to the amplifier negative input terminal 124 by a lead 126. As a result of this feedback configuration, the amplifier 112 is provided with a positive gain greater than unity. The amplifier output terminal 120 is A.C. coupled to output port 20 via a capacitor 128.

If the input music signal $V_{in}$ were continually modulated with the sawtooth $V_{mod}$ an undesirable switching noise would be apparent in $V_{out}$ when $V_{in}$ and $V_{out}$ are relatively low levels. To obviate this switching noise, $V_{mod}$ is applied to modulator 32 only when $V_{out}$ is greater than a predetermined power level. This is accomplished by actuating the transistor switch 106, to turn on oscillator 84 only when $V_{out}$ is greater than a predetermined threshold power level.

A unidirectional positive signal $V_{control}$ at point 130 is derived to have a value indicative of the power level of $V_{out}$. Point 130 is connected to amplifier output terminal via the series combination of a resistor 132 and a rectifier diode 134 to produce a positive unidirectional signal. The parallel combination of a resistor 136 and capacitor 138 are applied between point 130 and ground to form a low pass filter 140 having a time contant, on the order of several seconds. As a result, the signal $V_{control}$ is a slowly varying D.C. signal indicative of the power level of $V_{out}$. Point 130 is connected to the positive input terminal 142 of a comparator 144.

An adjustable reference voltage $V_{ref}$ is provided at the wiper 145 of a potentiometer 146 which is connected in series with a resistor 148 across the supply voltage B+. Wiper 145 is connected to the negative input terminal 150 of comparator 144. The comparator is of the type having a zero voltage on its output terminal 152 whenever the voltage at its positive input terminal 142 is less than the voltage at negative input terminal 150. When the voltage at the positive input terminal 142 exceeds the voltage at negative input terminal 150 a positive voltage appears on output terminal 152.

Output terminal 152 is coupled to the base electrode 108 of transistor switch 106 via a resistor 154. As a result, the transistor switch 106 is activated when $V_{control}$ exceeds $V_{ref}$.

While the preferred embodiment of the present invention has been described and illustrated in particular detail, it should be noted that numerous modifications, additions and omissions in the details thereof are possible within the intended spirit and scope of the invention claimed herein.

What is claimed is:

1. Apparatus for converting an input music signal composed of sequential note signal envelopes having a relatively rapid rise time and a relatively slow fall time to an output music signal whose sequential note signal envelopes have a relatively slow rise time and a relatively rapid fall time, said apparatus comprising: an input port adapted to be coupled to a source for said input music signal; a relaxation oscillator means for producing an output signal composed of periodic signal elements of generally sawtooth shape in response to the application of electrical power to said oscillator means; each said signal element having an amplitude which increases with time; modulator means having a first input terminal coupled to said input port and having a second input terminal fed by said oscillator means; said modulator means having an output terminal coupled to said output port; electrically actuatable switch means positioned for selectively applying electrical power to said oscillator means; rectifying and low pass filtering means fed from said output port and having an output control signal indicative of the average value of output signal power at said output port; means for comparing said control signal with a predetermined reference signal; said comparing means being coupled to said switch means and being configured for actuating said switch means when said control signal exceeds said predetermined reference signal.

* * * * *